US006359387B1

(12) United States Patent
Giannopoulos et al.

(10) Patent No.: US 6,359,387 B1
(45) Date of Patent: Mar. 19, 2002

(54) GAS-DISCHARGE LAMP TYPE RECOGNITION BASED ON BUILT-IN LAMP ELECTRICAL PROPERTIES

(75) Inventors: Demetri J. Giannopoulos, Norwalk, CT (US); Ihor T. Wacyk, Briarcliff Manor, NY (US)

(73) Assignee: Philips Electronics North America Corporation, New York, NY (US)

( * ) Notice: Subject to any disclaimer, the term of this patent is extended or adjusted under 35 U.S.C. 154(b) by 0 days.

(21) Appl. No.: 09/652,938

(22) Filed: Aug. 31, 2000

(51) Int. Cl.[7] ..... H01J 7/44

(52) U.S. Cl. ..... 315/46; 315/48; 315/94; 315/98; 315/105

(58) Field of Search ..... 315/291, 307, 315/209 R, DIG. 7, 94, 106, 107, 46, 48, 49, 53, 224, 97, 98, 105

(56) References Cited

U.S. PATENT DOCUMENTS 5,039,921 A 8/1991 Kakitani ..... 315/307
5,424,611 A * 6/1995 Moriarty, Jr. ..... 315/94
5,455,486 A * 10/1995 Tobler ..... 315/102
5,504,399 A * 4/1996 Tobler ..... 315/278
5,714,848 A * 2/1998 Hilbig et al. ..... 315/334
5,841,240 A * 11/1998 Beij et al. ..... 315/219
5,923,126 A * 7/1999 Yang et al. ..... 315/102
6,043,606 A * 3/2000 Arts et al. ..... 315/94

* cited by examiner

*Primary Examiner*—Don Wong
*Assistant Examiner*—Tuyet T. Vo

(57) ABSTRACT

A gas discharge lamp has an impedance element such as a capacitor connected to at least one electrode heater, to produce a heater impedance which falls within a range which is unique to lamps of that lamp type. An electronic ballast for operating such lamp has a lamp type detection circuit which measures the cold heater impedance and identifies the corresponding lamp type. The ballast may sample the heater circuit current to determine resistive and reactive components to aid in lamp type identification and to control heater warm-up. The ballast may include a separate inverter for heater power, and control heater power separate from arc power after lamp ignition.

21 Claims, 3 Drawing Sheets

GAS-DISCHARGE LAMP TYPE RECOGNITION BASED ON BUILT-IN LAMP ELECTRICAL PROPERTIES

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The invention relates to electronic lamp ballasts capable of driving lamps of different types, and in particular to such ballasts which automatically recognize the type of lamp by measuring electrical parameters of an installed lamp, before or after ignition.

A method which recognizes the lamp type by pre-ignition measurement involves measuring the electrode heater resistance. Applicability of this approach is limited due to the similar electrode resistance values exhibited by the majority of known lamp types.

U.S. Pat. No. 5,039,921 teaches measurement of the lamp ignition voltage. However, this method has limited applicability because several lamp types have similar ignition voltage values, and because the ignition voltage depends on lamp temperature.

Another recently proposed method involves measuring several points of the lamp I-V curve after lamp ignition. However, if a low lamp output level is required after lamp ignition, such as with lamp dimming, then initial measurement of the I-V curve at high (full) lamp output levels will result in a flash upon ignition, before the dimming occurs.

BRIEF SUMMARY OF THE INVENTION

An object of the invention is to identify a gas-discharge lamp type, installed for operation with an electronic ballast, by an electrically measurable property prior to lamp ignition.

Another object of the invention is to provide a system by which lamps of different types, and in particular different power ratings, having a same lamp base arrangement and similar physical size can be used in a luminaire without user adjustment.

According to the invention, each of the lamp types usable with the electronic ballast is a type having at least one electrode heater, and the heater impedance falls within a range of impedances which is unique with respect to the others of the usable lamp types. The ballast includes a type detection circuit which measures the heater impedance while the electrodes are being heated, and a control circuit which sets the ballast operating parameters to the predetermined values for that lamp type. Where a lamp has two electrode heaters, such as a conventional fluorescent lamp, the heaters are usually connected to separate heater secondary windings on a transformer, and the impedance of the parallel combination is measured by measuring the primary winding current, or current and voltage.

In a preferred embodiment of the invention, all but one of the lamp types includes a capacitor in parallel with the electrode heater. If there are plural heaters, separate capacitors may be in parallel with each of the heaters. The capacitors have values chosen such that the absolute magnitudes of the electrode impedances fall within separate ranges for the different types.

According to another embodiment of the invention, all lamp types with which the ballast is intended to be used, in a given luminaire type, include a respective capacitor in parallel with at least one electrode heater. This embodiment has the advantage that older production lamps of the same general type, but lacking identifying impedance elements, will be identified as non-conforming so that lamp ignition can be prevented.

In yet another embodiment of the invention, a non-linear impedance element is connected to the heater, the non-linear element having the property of effecting a large change in initial heater impedance, but having lesser effect subsequently, especially during normal operation.

A first embodiment of a ballast circuit for use with such lamp types may include any well-known type of electronic arc current ballast having an arc current inverter operating at a high frequency, such as one typically between 20 kHz and 100 kHz, except that the electrode heaters are connected to separate heater windings on a high frequency heater transformer driven by a second, low power inverter. When the ballast is first energized, the low power inverter is controlled to oscillate at a predetermined frequency, and the arc current inverter is turned off. The current flowing through the heater transformer primary is then determined entirely by the electrode heating circuit load. A digital sampling circuit produces signals indicating which range the initial heating circuit impedance falls in, and the combined heater resistance. After the heaters have been adequately heated, for example when the heater resistances are four times the initially observed resistance, the arc current inverter is enabled and is controlled according to the desired parameters for the lamp type corresponding to the heating circuit impedance. For example the frequency or a combination of frequency and conduction angle of the inverter switches are controlled to provide the desired lamp power (lamp output) so that, if set by external controls for a dimming mode, the lamp does not have a bright flash before dimming to the set mode.

This embodiment has the advantage that the lamp electrode current can be controlled independent of the arc current, for example by controlling inverter conduction angle (pulse width modulation). Because the electrodes consume very little power the required inverter can be quite simple and small, and RF filtering of the electrode current will usually not be required. One model of ballast can be programmed to operate a preselected group within a wide variety of lamps. Further, the electrode current can be reduced or eliminated at high light output levels, while increasing the electrode heater current at low lamp output levels, thereby improving life time of the lamp and the efficiency of the combination.

A second embodiment of a ballast for use with such lamps requires only one inverter and transformer, but has a more complex control routine. The ballast has a resonant load circuit to which the lamp electrodes are connected, either directly or through an isolating transformer. The electrode heaters are connected either to a separate heater transformer whose primary is driven by the same inverter, or to separate heater windings on the isolating transformer. In this embodiment, when the ballast is initially energized it may be controlled to oscillate at a frequency sufficiently different from the normal operating frequency that the voltage across the arc electrodes is below that which will cause any lamp to strike. The current through the filament or isolating transformer is a measure of the heating electrode impedance. After the lamp type has been determined, the inverter frequency is set to the correct value for that lamp type so that proper ignition and desired operation can be achieved.

Where the ballast resonant load circuit has a series resonant capacitor across which the lamp is connected, the initial frequency is preferably well above the operating frequency range. This arrangement not only reduces the possibility of premature ignition before the lamp identification circuitry has completed setting the desired operating parameters, but also permits easy distinguishing between lamp types using relatively low value capacitors.

In a variation of the invention useful with multiple-lamp luminaires operated from a single ballast, separate heater transformers and identification circuits are used for each lamp. The control circuit is arranged to prevent ignition if incompatibly different lamp types, such as substantially different wattage ratings, are installed simultaneously in the same luminaire. This variation may be used with either the first or the second embodiment. However, driving a variety of lamps with the same model ballast according to the second embodiment becomes difficult, because of the fixed relationship between the electrode heater drive and the arc voltage.

The invention is useful not only with pre-heat and rapid start low pressure fluorescent lamps, but also with any other type of arc discharge lamp having at least one electrode heater and requiring a current limiting or lamp controlling ballast. The invention is also applicable whether the electrode heating is direct (filament electrode) or indirect (heater electrically insulated from the electrode).

DETAILED DESCRIPTION OF THE INVENTION

Figure 1:
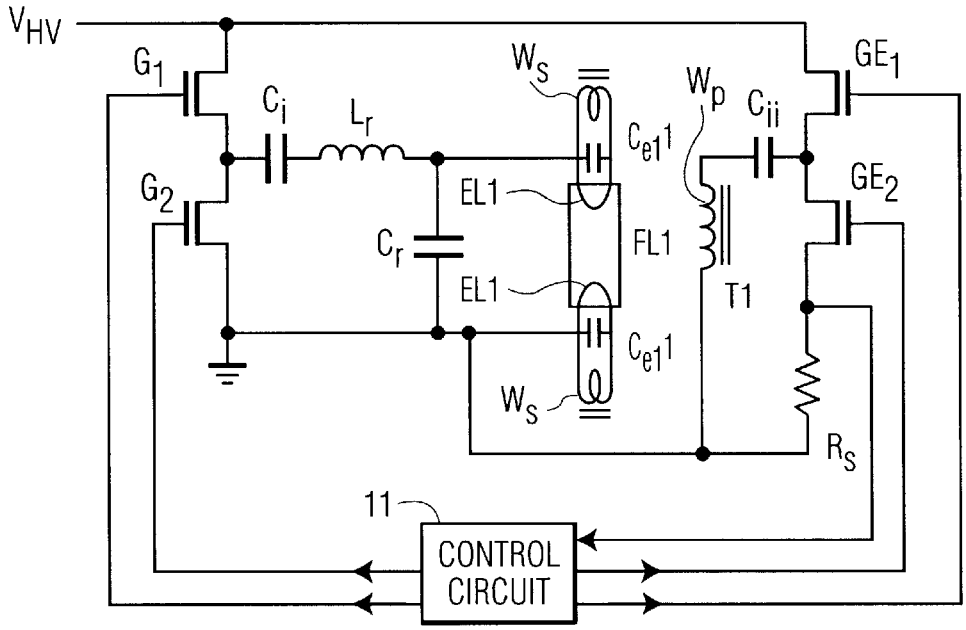
FIG. 1 is a simplified schematic diagram of a ballast and fluorescent lamp arrangement having two impedance elements and a separate heater inverter.

The combination of lamp and ballast shown in the simplified schematic of FIG. 1 differs from those commonly used in three respects: lamp type identification, ballast control regime, and the use of two inverters from the one DC supply. A conventional power supply, which may be of any desired type, provides high voltage DC power over line VHV to an arc current inverter having two high frequency switches, shown as transistors $G_1$ and $G_2$. The arc current inverter is coupled through a DC isolating capacitor $C_i$ to a resonant load circuit formed by a resonance inductor $L_r$ and a resonance capacitor $C_r$. In this embodiment the load is a fluorescent lamp FL1 having a type-identifying capacitor Cell connected in parallel with a filamentary electrode heater EL1 at each end of the lamp. One terminal at each lamp end is connected to a respective terminal of the resonance capacitor Cr.

It will be clear that, with no other change in the circuit, an isolation transformer can be provided between the lamp FL1 and the resonance capacitor $C_r$.

The DC supply voltage $V_{HV}$ is also applied to an electrode heater inverter formed by two switches such as transistors $GE_1$ and $GE_2$ connected in series with a measuring resistor $R_s$. The electrode heater inverter output is connected to the primary winding $W_p$ of a high frequency transformer T1 having n turns, through a DC isolating capacitor $C_{ii}$. The transformer T1 has two identical secondary windings $W_s$, each being connected across the ends of a respective one of the heaters EL1.

A control circuit 11 receives the voltage across resistor $R_s$ as a first input, and as a first output provides control signals to the switches $GE_1$ and $GE_2$. A second output from the control circuit 11 provides control signals to the switches $G_1$ and $G_2$. Optionally, the control circuit may also sense the DC voltage $V_{HV}$ so that impedance determination is independent of variation in the value of the inverter input voltage. The control circuit 11 preferably contains a small microprocessor having a memory or look-up table for determining the correct operating parameters of the arc current inverter based on the lamp type identified initially.

When the ballast is first energized, the control 11 causes the heater inverter to operate at a predetermined frequency, typically between 20 kHz and 60 kHz. The voltage across the resistor $R_s$ is sampled to determine the cold impedance presented by the two heater circuits of the lamp FL1 and, preferably, also the cold resistance. A microprocessor control unit in the control circuit determines the lamp type corresponding to the cold impedance. When the electrodes have reached the correct temperature, determined for example as a resistance 4 times the cold resistance, the arc current inverter formed by switches G1 and G2 is enabled, and its frequency and/or conduction angle are controlled to produce the predetermined operating values for that lamp type.

The capacitor values for $C_{el}$1 can be chosen so that the absolute value of the individual electrode circuit impedance Z has a unique range for each lamp type that is suitable for use in a given luminaire. For example, three common types have the nominal electrode resistance given in the following table. Component tolerances may differ for different types. The example in Table 1 assumes tolerances of 30% for electrode heater resistance and 10% for capacitors, and a heater inverter frequency of 50 kHz. Because they need only a small voltage rating, typically less than 10 v, these capacitors are small and inexpensive.

TABLE 1

| Lamp Type | $R_{el}$ | $C_{el}$ | $Z^{max}$ | $Z^{nom}$ | $Z^{min}$ |
|---|---|---|---|---|---|
| PL-L55W | 2.0Ω | 3.9 μf | 1.05 | 0.75 | 0.45 |
| PL-L36W | 3.0Ω | 1.5 μf | 2.45 | 1.75 | 1.05 |
| PL-L40W | 3.5Ω | none | 4.55 | 3.5 | 2.45 |

If it is desired to distinguish between lamps of older manufacture lacking type-identifying impedance elements, which may fit in the same luminaire, and lamps according to the invention, each type may be required to have an impedance element. To avoid requiring relatively large capacitances for some types, which will increase the current required from the heater inverter, the type detection circuit can sample near the zero heater voltage point, to identify solely by the reactive portion of the electrode circuit impedance. This will greatly reduce the spread of capacitor values required to provide a unique range for each type.

The circuit of FIG. 1 shows the measuring resistor in the inverter path. However, it will be clear that substantially identical results can be obtained by placing the measuring resistor in series with the primary winding of the transformer T1. Further, in the preferred embodiments all the electrode heaters of a given lamp are powered from the same inverter and transformer primary, so the same effect can be obtained if a single capacitor of twice the capacitance is connected across one of the electrode heaters. This would be especially advantageous if the lamp has a single base providing electrical connections for both ends of the arc tube.

Figure 2:
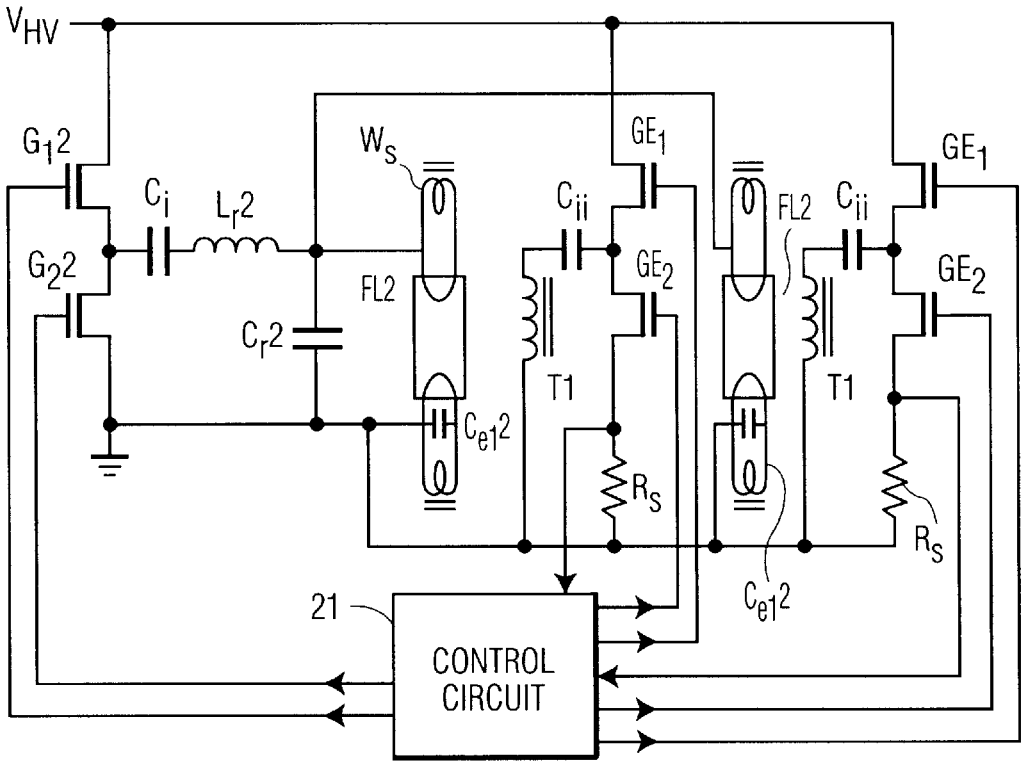
FIG. 2 is a simplified schematic diagram of a variation of the ballast of FIG. 1 for driving two fluorescent lamps, shown as each having a single impedance element and a separate heater inverter.

The ballast and lamp arrangement of FIG. 2 is basically like that of FIG. 1, and the components with the same reference character may have the same value. The arc current inverter formed by switches $G_1$2 and $G_2$2 has greater current capacity to handle two lamps, the resonant components $L_r$2 and $C_r$2 likewise usually have different values, the lamps are shown as having only one impedance element, or capacitor $C_{el}$2, each, and the control circuit 21 has an additional input for impedance sensing and additional outputs for the second heater inverter. To identify a same basic lamp type, the capacitors $C_{el}$2 will have twice the capacitance of those used in a two-capacitor lamp. Thus lamps FL1 and FL2 can be used interchangeably.

The control circuit 21 functions like that of FIGS. 1 and 2, but has inputs for two different measuring resistors, and outputs for two different heater inverters.

The ballast of FIG. 2 has two electrode heater inverters, one for each lamp, which each may be identical to the heater inverter of FIG. 1. This allows independent control of the heater power in each lamp. Alternatively, and in what is usually a preferred embodiment, both transformers T1 can be powered from a single electrode heater inverter, with a separate measuring resistor in series with each primary winding. This reduces the parts count, while still enabling identification of the presence of one lamp only, or an undesirable installation of differing lamp types in the same luminaire.

Figure 3:
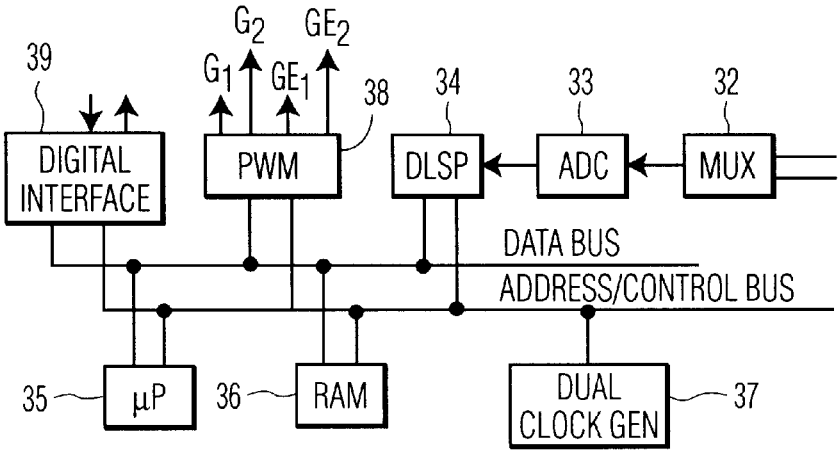
FIG. 3 is a simplified block diagram of a control circuit for the embodiment of FIG. 1.

The control circuit shown in a simplified block diagram in FIG. 3 contains well known subcircuits interconnected by a data bus and an address/control bus. A multiplexer 32 receives the analog signal from the measuring resistor $R_s$, and may also receive signals indicative of the high voltage $V_{HV}$, or a dimmer setting. An analog/digital converter 33 receives the multiplexer output and provides digital signals to a digital lamp signal processor 34. Logical determination of the lamp type, and higher level controller functions, are performed in a microprocessor 35. A random access memory 36 is shown separately, but may form part of one of the processors. A dual clock generator 37 provides clock signals for both inverters; preferably a fixed frequency for the heater inverter, and a frequency for the arc current inverter which is based on the lamp type determination. A pulse width modulation unit 38 provides control signals for the switches G1, G2, GE1 and GE2; the heater inverter switches may be pulse width controlled to control heater power, while the arc current inverter is controlled by frequency and/04 switching time to provide desired lamp operating parameters. A digital interface 39 may be included to interface with a central control for the room or building.

Figure 4:
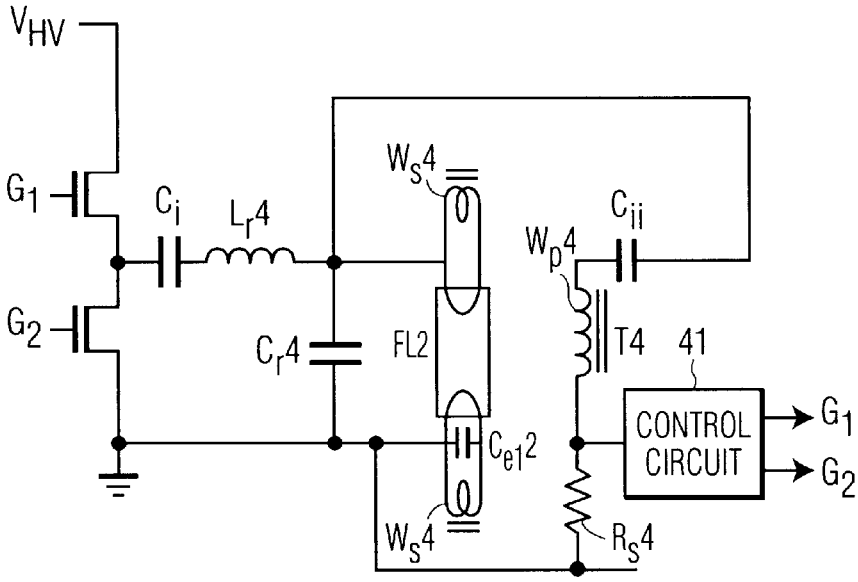
FIG. 4 is a simplified schematic diagram of a ballast and fluorescent lamp arrangement having a single impedance element and a heater transformer driven by the operating current inverter.

The embodiment of FIG. 4 has the lowest parts count, but offers less flexibility in powering different lamp types and eliminates control of the heater power during operation. The resonance components $L_r$4 and $C_r$4 may have the same values as those of FIG. 1 because the loading by the electrode heater circuitry is small. Except for a difference in the number of turns in the primary winding $W_p$4 and the secondary windings $W_s$4, the transformer T4 may be similar to the transformer T1. The current through measuring resistor $R_s$4 is solely the heater circuit load, so that lamp type determination is readily performed.

The control circuit 41 will be structurally like that of FIG. 3, except that only a single clock generator is required, and the pulse width modulator drives only one inverter. The ballast may initially be operated at a predetermined frequency and/or pulse width at which the voltage across $C_r$4 is less than what will cause any lamp type to ignite. After the cold impedance has been measured, the installed lamp type is determined. The inverter is then operated normally for that lamp type.

Figure 5:
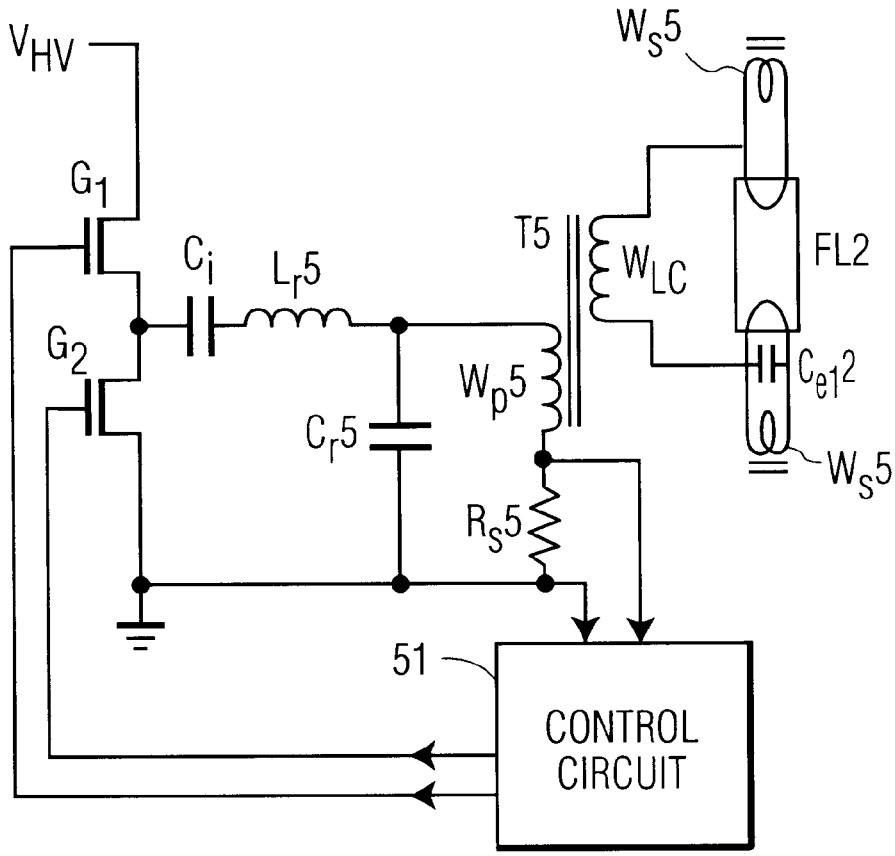
FIG. 5 is a simplified schematic diagram of a ballast and fluorescent lamp arrangement having a single impedance element and a single transformer for operating the lamp.

The circuit of FIG. 5 is looks like that of FIG. 4, except that a common single isolating transformer T5 is used, having a typical primary winding $W_p$5, lamp current winding $W_{LC}$, and heater secondary windings $W_s$5. Operation of this arrangement is like that of the embodiment of FIG. 4, except that any added components associated with the lamp circuit may affect the current through the measuring resistor $R_s$5 before lamp ignition, and therefore make lamp type identification more difficult. After ignition, the voltage across the measuring resistor $R_s$5 will be much greater than in the other embodiments, but it may be used to detect the lamp operating parameters to achieve desired control.

It will be clear to those of ordinary skill that many variations may be made within the spirit of the invention. In particular, the arc current inverter and its load may have other configurations, including those involving power feedback. The independent control of the electrode heater power both during measurement and normal operation allow optimization of the lamp life and overall efficiency.

What is claimed is:

1. In combination, a gas discharge lamp having external connections for at least one electrode heater, and an electronic ballast for operating the lamp, characterized in that:

said lamp includes at least one impedance element connected to the at least one electrode heater, thereby producing a heater impedance falling within a range of impedances which is unique to a given lamp type, and said ballast includes a type detection circuit for measuring heater impedance prior to lamp ignition, and a control circuit for setting ballast operating parameters to at least one value predetermined for the detected lamp type.

2. A combination as claimed in claim 1, characterized in that said at least one impedance element comprises a capacitor connected in parallel with said one electrode heater.

3. A combination as claimed in claim 1, characterized in that said type detection circuit measures solely the current drawn by said at least one electrode heater and said at least one impedance element.

4. A combination as claimed in claim 1, characterized in that said at least one impedance element includes a reactive element, and said type detection circuit samples the current drawn by said at least one electrode heater and said at least one impedance element to determine the electrode heater resistance.

5. A combination as claimed in claim 1, characterized in that said at least one impedance element includes a reactive element, and said type detection circuit samples the current drawn by said at least one electrode heater and said at least one impedance element to determine the reactance of said at least one impedance element.

6. A combination as claimed in claim 1, characterized in that the lamp includes two heaters and at least one said impedance element, and said type detection circuit measures the total current drawn by the electrode heaters and said at least one said impedance element.

7. A combination as claimed in claim 1, characterized in that said ballast includes a single inverter only, and a transformer connected to receive power from said inverter, said transformer including at least one heater winding.

8. A combination as claimed in claim 1, characterized in that said ballast includes a first inverter for providing lamp arc current, and a second inverter for providing current to said at least one electrode heater and said at least one impedance element.

9. A combination as claimed in claim 8, characterized in that said ballast includes means for controlling electrode heater power after ignition of the lamp.

10. A combination as claimed in claim 9, characterized in that said control circuit sets the inverter operating condition to an initial value sufficiently different from the operating values for lamp types usable with said ballast that voltage across the arc electrodes is below that which will cause any lamp to strike.

11. A gas discharge lamp of a given lamp type, having an electrode heater and external electrode connections for said heater, characterized in that the lamp comprises an impedance element connected to said heater, thereby producing a heater impedance as observed at said electrode connections which is within a range of impedances unique to said given lamp type.

12. A lamp as claimed in claim 11, characterized in that said impedance element comprises a capacitor.

13. A lamp as claimed in claim 11, characterized in that said lamp comprises two said electrode heaters, and at least one impedance element connected to a respective one of said electrode heaters.

14. An electronic ballast for operating a gas discharge lamp having an electrode heater and means for producing a heater impedance falling within a range of impedances which is unique to a given lamp type, characterized in that said ballast comprises:

a type detection circuit for measuring heater impedance prior to lamp ignition, and a control circuit for setting ballast operating parameters to at least one value predetermined for the detected lamp type.

15. A ballast as claimed in claim 14, for operating a lamp having at least one said heater, characterized in that said type detection circuit measures the magnitude of total current drawn by the at least one electrode heater and said means for producing a heater impedance.

16. A ballast as claimed in claim 14, characterized in that said type detection circuit samples the current drawn by said at least one electrode heater and said at least one impedance element to determine the electrode heater resistance.

17. A ballast as claimed in claim 14, characterized in that said type detection circuit samples the current drawn by said at least one electrode heater and said at least one impedance element to determine the reactance of said at least one impedance element.

18. A ballast as claimed in claim 14, characterized in that said ballast includes a first inverter for providing arc current to the lamp, and a second inverter for providing current to said electrode heater and said means for producing a heater impedance.

19. A ballast as claimed in claim 18, characterized in that said ballast includes means for controlling electrode heater power after ignition of the lamp.

20. A ballast as claimed in claim 14, characterized in that said ballast includes a single inverter only, and a transformer connected to receive power from said inverter, said transformer including at least one heater winding.

21. A ballast as claimed in claim 20, characterized in that said control circuit sets the inverter operating conditions to an initial value sufficiently different from the operating conditions for lamp types usable with said ballast that voltage across the arc electrodes is below that which will cause any lamp to strike.

* * * * *